United States Patent [19]

Rytlewski

[11] Patent Number: 4,951,744

[45] Date of Patent: Aug. 28, 1990

[54] ANGULARLY SHAPED UNITARY STRUCTURED BASE STRIP COMPRISED OF A SPECIFIC MATERIAL ADAPTED FOR PHASING CHARGES IN A PERFORATING GUN

[75] Inventor: Gary L. Rytlewski, League City, Tex.

[73] Assignee: Schlumberger Technology Corporation, Houston, Tex.

[21] Appl. No.: 394,782

[22] Filed: Aug. 16, 1989

[51] Int. Cl.[5] ..... E21B 43/116; F42B 3/00

[52] U.S. Cl. ..... 175/4.57; 166/55; 102/312; 102/313; 102/320; 102/321; 102/331

[58] Field of Search ..... 166/297, 298, 369, 376, 166/55, 55.1, 177; 175/4.5, 4.51, 4.55, 4.57, 4.6, 3.5, 2; 102/306, 310, 319, 314, 320, 321, 322, 331, 372, 312, 313

[56] References Cited

U.S. PATENT DOCUMENTS

| | | | |
|---|---|---|---|
| 2,756,677 | 7/1956 | McCullough | 102/310 |
| 2,833,214 | 8/1951 | Spencer | 175/4.6 |
| 3,636,875 | 1/1972 | Dodson . | |
| 4,326,462 | 4/1982 | Garcia et al. . | |
| 4,393,946 | 7/1983 | Pottier et al. . | |
| 4,496,008 | 1/1985 | Pottier et al. . | |
| 4,543,703 | 10/1985 | Wetzel et al. | 29/455 R |
| 4,694,754 | 9/1987 | Dines et al. | 102/310 |

OTHER PUBLICATIONS

Materials, Parts and Finishes Encyclopedia/Handbook, H. R. Clauser-Editor, 1984 Edition, (pp. 15 to 20).

Metals Handbook (Ninth Edition)-vol. 2, Properties and Selection: Nonferrous Alloys and Pure Metals, 1979 Edition, (pp. 123 to 139).

*Primary Examiner*—Ramon S. Britts
*Assistant Examiner*—Ezio DiSante
*Attorney, Agent, or Firm*—John H. Bouchard; Henry N. Garrana

[57] ABSTRACT

A perforating gun includes a base strip having an angular cross section, the base strip being a single unitary structure and essentially comprising at least two longitudinally disposed surfaces, a first surface and a second surface, a first plurality of capsule charges being connected to the first surface and a second plurality of capsule charges being connected to the second surface and interleaved with the first plurality of capsule charges, thereby phasing the capsule charges in the perforating gun. Since the gun utilizes capsule charges, good penetration into the formation is achieved. Due to the cross sectional configuration of the base strip, the phased capsule charges, when mounted on the strip, will easily fit within a tubing string previously used by non-phased capsule charge perforating guns. Since the base strip is a single, unitary structure, it is rugged enough to avoid shattering upon impact with an obstruction in a borehole, yet, due to its chemical and mechanical properties, will shatter in response to detonation of the capsule charges.

7 Claims, 6 Drawing Sheets

FIG. 6a

TABLE OF 7000 SERIES Al ALLOYS

| ALLOY | TEMPER | TENSILE STRENGTH MPa | TENSILE STRENGTH ksi | YIELD STRENGTH MPa | YIELD STRENGTH ksi | ELONGATION (a), % (b) | ELONGATION (a), % (c) | HARD-NESS (d) | SHEAR STRENGTH MPa | SHEAR STRENGTH ksi | FATIGUE STRENGTH (e) MPa | FATIGUE STRENGTH (e) ksi |
|---|---|---|---|---|---|---|---|---|---|---|---|---|
| 7005 | O | 193 | 28 | 83 | 12 | 20 | --- | --- | 117 | 17 | --- | --- |
| | T53 | 393 | 57 | 345 | 50 | 15 | --- | --- | 221 | 32 | 140 | 20 |
| | T6, T63, T6351 | 372 | 54 | 315 | 46 | 12 | --- | --- | 214 | 31 | 125 | 18 |
| 7049 | T73 | --- | --- | --- | --- | --- | --- | 135 | --- | --- | 295(k) | 43(k) |
| 7050 | T736 | 515 | 75 | 455 | 66 | 11 | 15 | --- | --- | --- | 240(k) | 35(k) |
| 7072 | O | --- | --- | --- | --- | --- | --- | 20 | 55 | 8 | --- | --- |
| | H12 | --- | --- | --- | --- | --- | --- | 28 | 62 | 9 | --- | --- |
| | H14 | --- | --- | --- | --- | --- | --- | 32 | 69 | 10 | --- | --- |
| 7075 | O | 230 | 38 | 105 | 15 | 17 | 16 | 60 | 150 | 22 | --- | --- |
| | T6, T651 | 570 | 83 | 505 | 73 | 11 | 11 | 150 | 330 | 48 | 160 | 23 |
| | T73 | 505 | 73 | 435 | 63 | 13 | --- | --- | --- | --- | --- | --- |
| ALCLAD 7075 | O | 220 | 32 | 95 | 14 | 17 | --- | --- | 150 | 22 | --- | --- |
| | T6, T651 | 525 | 76 | 460 | 67 | 11 | --- | --- | 315 | 46 | --- | --- |
| 7175 | T66 | 595 | 86 | 525 | 76 | 11 | --- | 150 | 325 | 47 | 160 | 23 |
| | T736 | 525 | 76 | 455 | 66 | 14 | --- | 145 | 290 | 42 | 160 | 23 |
| 7475 | T61 | 525 | 76 | 460 | 67 | 12 | --- | --- | --- | --- | --- | --- |
| | T651 | --- | --- | --- | --- | --- | --- | --- | 295 | 43 | --- | --- |
| | T7351 | --- | --- | --- | --- | --- | --- | --- | 270 | 9 | 220 | 32 |
| | T7651 | --- | --- | --- | --- | --- | --- | --- | 270 | 39 | --- | --- |

FIG.7a
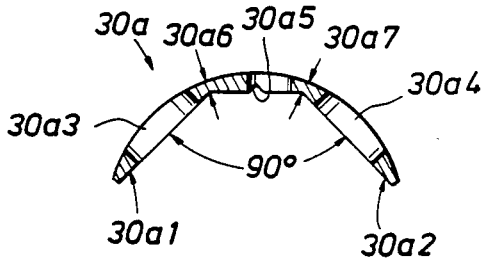
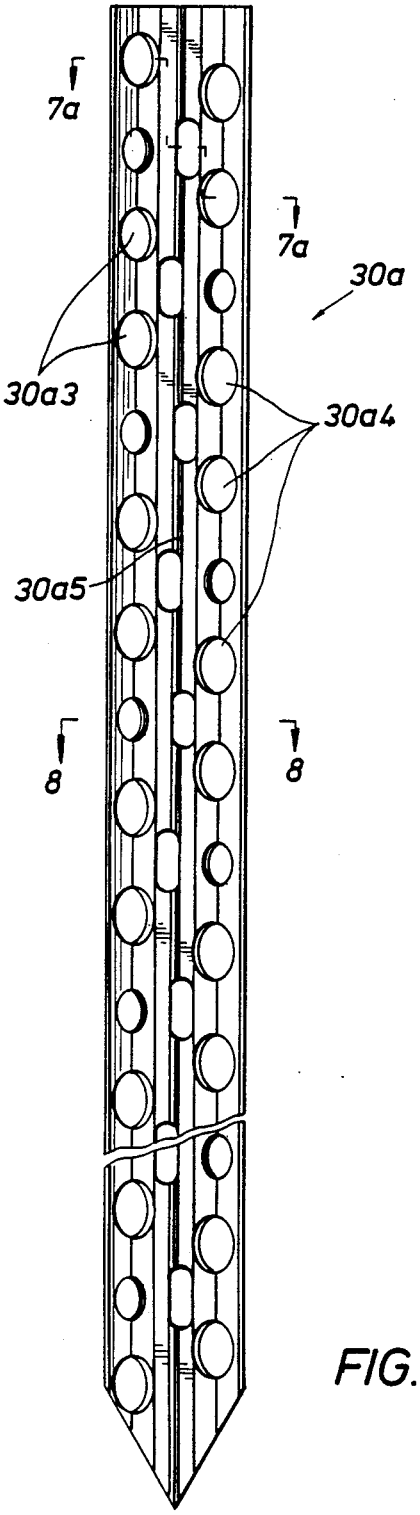
FIG.7b
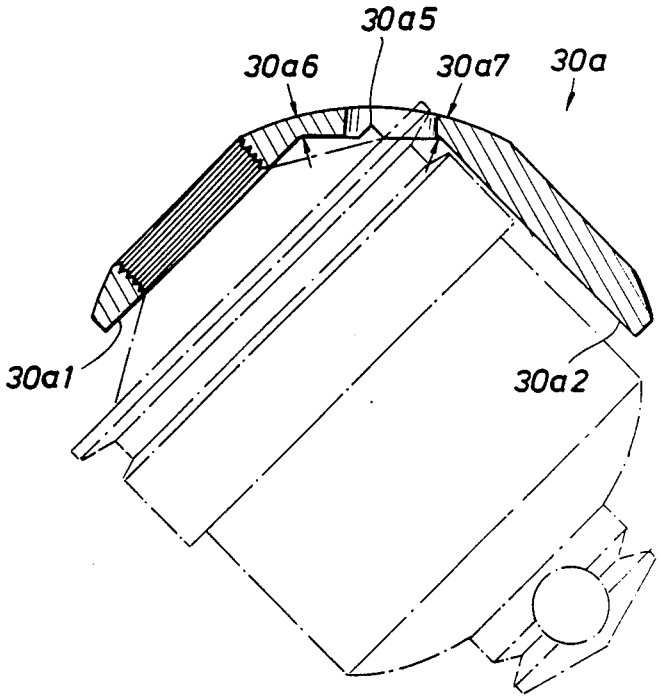
FIG.8

ANGULARLY SHAPED UNITARY STRUCTURED BASE STRIP COMPRISED OF A SPECIFIC MATERIAL ADAPTED FOR PHASING CHARGES IN A PERFORATING GUN

BACKGROUND OF THE INVENTION

The subject matter of the present invention relates to perforating guns for well tools, and more particularly, to an array of capsule charges mounted on a single, rigid, unitary structure, in a phased manner, the structure having an angular cross-sectional configuration, the packaging of the capsule charges on the structure in the perforating gun being accomplished without requiring an increase in the diameter of the perforating gun relative to prior art perforating guns.

Perforating guns used in oil well boreholes, for perforating a formation, are comprised of charges mounted on a base structure. The charges are often phased, that is, pointed in different directions, for perforating along a 360 degree circumference of the borehole. Of course, the charges are often not phased. In either case, the charges are mounted on a base strip. The charges may be capsule charges, that is, sealed against ambient temperature and pressure, or they may be normal, non-capsule charges, that is, not sealed against such ambient temperature and pressure. In the non-phased capsule charge situation, the charges perforate the formation in one direction only. In the phased capsule charge situation, the base strip is often a set of wires or a plurality of tubes connected together by a corresponding plurality of cotter pins. When the phased capsule charges are moving downhole, the wires or cotter pins often break when the charges hit an obstruction in the borehole. In addition, some phased charges are mounted on a straight bar, and a primer cord is run longitudinally through or around the bar for connection to the charges. While the bar may be rigid enough to withstand an impact with the obstruction in the borehole, the straight bar configuration requires an increased diameter perforating gun relative to other such non-phased capsule charge perforating guns. Therefore, the straight bar, phased charge prior art gun cannot fit within the same tubing string that is used with respect to the non-phased charge perforating gun. One prior art perforating gun, similar to the straight bar, phased charge perforating gun discussed above, is found in U.S. Pat. No. 4,543,703 to Wetzel et al. In this patent, a base carrier, cross sectionally shaped in the form of a polygon, has a plurality of shape charges affixed thereto, a subset of the plurality of charges being fixed to each of the sides of the polygon shaped carrier. The perforating gun of the Wetzel patent appears to be very similar in configuration to the straight bar, phased charge perforating gun (illustrated in FIG. 3 of the drawings). Wetzel suffers from the same disadvantage that is possessed by the straight bar, phased charge perforating gun of FIG. 3; that is, the diameter of the Wetzel gun is increased relative to the diameter of the non-phased charge perforating gun (shown in FIG. 4). Consequently, the gun of the Wetzel patent cannot fit into the same tubing string that is used with respect to the non-phased charge perforating gun. Furthermore, it is possible to utilize non-capsule charges (charges not sealed against adverse ambient pressures and temperatures) in perforating guns and phase the non-capsule charges; however, when using the non-capsule charges, a carrier is required to surround and protect the non-capsule charges from the hostile ambient temperatures and pressures often found in a borehole of an oil well. Therefore, since all the above referenced prior art designs are deficient in some manner, a new design is required for perforating guns whereby capsule charges may be used thereby providing good penetration of the formation and eliminating the need for carriers, and such capsule charges may be phased without requiring an increase in the diameter of the perforating gun in which the charges are mounted relative to other non-phased charge perforating guns. Such capsule charges must be mounted on a base strip which is rigid enough to avoid shattering or severe deformation when the structure impacts an obstruction in a borehole, will allow for phasing of capsule charges mounted thereon, and yet will shatter when the charges in the gun detonate. Therefore, the new perforating gun is one which is rugged, that is, one which will not become stuck or will not shatter in a borehole when an obstruction is impacted, one which has good penetration of the formation due to its use of capsule (sealed) shape charges, one which phases its charges along at least two directions, and one which does not require an increased diameter tubing string.

SUMMARY OF THE INVENTION

It is a primary object of the present invention to design a perforating gun which is rugged, has good penetration, phases its capsule shape charges, and, since its diameter is not increased relative to other non-phased charge perforating guns of the prior art, does not require the use of an increased diameter tubing string.

It is a primary object of the present invention to design a new phased capsule charge perforating gun which comprises a plurality of capsule charges mounted on a single unitary structure, the structure being packaged in a way which will allow the charges to be phased in at least two directions without increasing the diameter of the perforating gun relative to non-phased charge perforating guns.

It is a further object of the present invention to design the new phased capsule charge perforating gun which comprises the plurality of phased capsule charges mounted on a single unitary structure, the structure being shaped, sized and comprised of a unique material in order to allow the structure to withstand an impact with an obstruction disposed downhole in a borehole and to shatter upon detonation of the phased capsule charges.

It is a further object of the present invention to design a new phased capsule charge perforating gun which has a diameter that is substantially the same as the diameter of prior art non-phased charge perforating guns and which includes a base strip, having charges mounted thereon, that comprises a single unitary structure which: (1) is angularly shaped to allow for phasing of the capsule charges to be mounted thereon, (2) includes a number of grooves and holes to assist in the shattering of the strip in response to charge detonation, (3) is comprised of a specific material designed to further assist in the shattering of the strip in response to charge detonation, and (4) is comprised of the specific material designed to withstand an impact with an obstruction in a borehole.

These and other objects of the present invention are achieved by designing a perforating gun comprising a single unitary base strip, and a plurality of capsule charges mounted on the base strip, the base strip being shaped in cross-section so as to define at least two surfaces, each surface lying on a different longitudinally disposed plane, at least a first capsule charge being disposed on one of the at least two surfaces, and at least a second capsule charge being disposed on the other of the at least two surfaces of the single unitary base strip, the first capsule charge pointing in a direction which is different than the direction in which the second capsule charge is pointing. The single, unitary base strip is made of an Aluminum Alloy material, "Aluminum 7075-T6511", which allows the base strip to withstand an impact with an obstruction when the perforating gun is being disposed in a borehole, but will allow the strip to shatter into pieces when the charges of the perforating gun detonate. The single, unitary base strip includes a number of grooves and holes designed to assist in the shattering of the strip in response to charge detonation; the base strip and phased capsule charges being packaged together in a way which will not increase the overall diameter of the perforating gun relative to non-phased perforating guns of the prior art.

Further scope of applicability of the present invention will become apparent from the detailed description presented hereinafter. It should be understood, however, that the detailed description and the specific examples, while representing a preferred embodiment of the invention, are given by way of illustration only, since various changes and modifications within the spirit and scope of the invention will become obvious to one skilled in the art from a reading of the following detailed description.

BRIEF DESCRIPTION OF THE DRAWING

A full understanding of the present invention will be obtained from the detailed description of the preferred embodiment presented hereinafter, and the accompanying drawings, which are given by way of illustration only and are not intended to be limitative of the present invention, and wherein:

FIG. 2 including

FIG. 6*a* illustrates a table of 7000 series Aluminum alloys, as defined by the Aluminum Association;

FIGS. 7*a* and 7*b* illustrate the base strip of FIG. 6 on which the capsule charges are mounted; and FIG. 8 illustrates an enlarged, cross sectional view of the base strip of FIG. 7*a*.

DETAILED DESCRIPTION OF THE PREFERRED EMBODIMENT

In any perforating gun, it is important that the gun be rugged, that is, it will not become stuck in the oil well during operation. If a gun is not rugged, and is broken or otherwise severely deformed during operation, it is possible that live charges from the gun may become stuck in the well. Such charges must be recovered (salvaged) at considerable expense. During this salvaging operation, there is a risk that the charges will detonate at the wrong depth of the well. A superior perforating gun is one which: (1) upon firing, penetrates the formation over a distance greater than the penetration distance associated with any other gun of the same diameter, (2) phases the charges in the gun, and (3) is rugged and durable enough to traverse the wellbore without fracturing or becoming stuck in the wellbore. Some prior art guns, e.g., the strip type gun, are rugged (will not become stuck in the well) and has a good penetration distance, but the charges in this gun are not phased. Other prior art guns, e.g., the hollow carrier type gun, are rugged and the charges are phased, but the penetration distance associated with this other type of prior art perforating gun is lower than that of other guns of the same diameter. For example, in the hollow carrier type gun, the hollow carrier requires a charge of reduced size; the reduced size charge produces a lower penetration distance for a given gun diameter. The perforating gun of the present invention is designed to provide optimum penetration distance, charge phasing, and the required ruggedness.

Figure 1A:
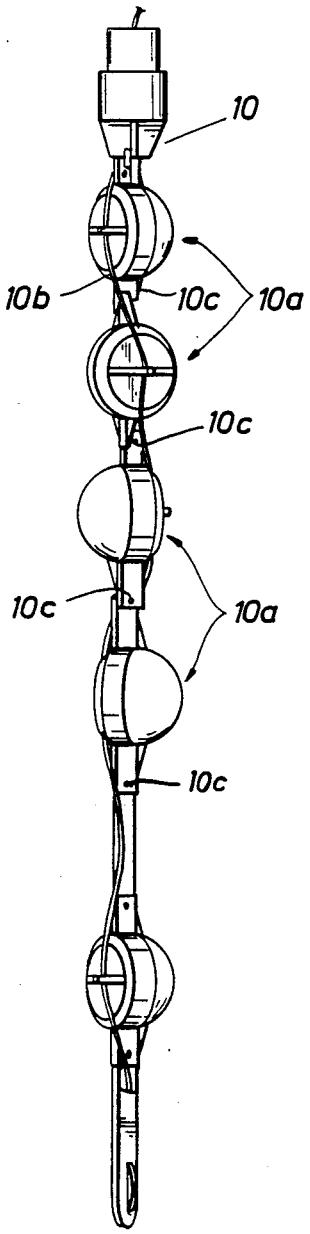
FIG. 1a (PRIOR ART)
FIG. 1 including FIG. 1*a* and FIG. 1*b* illustrates the prior art capsule and link type fully expendable perforating guns.
Figure 1B:
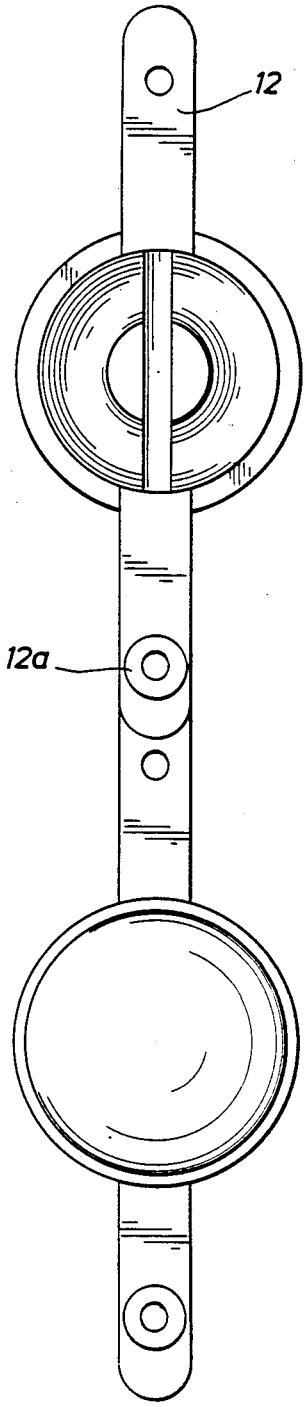
FIG. 1b (PRIOR ART)

Referring to FIG. 1, inclusive of FIG. 1*a* and 1*b*, prior art embodiments of perforating guns are illustrated.

In figures 1*a* and 1*b*, capsule or link type fully expendable prior art guns are illustrated. In FIG. 1*a*, gun 10 is a prior art capsule charge type gun, the capsule charges being phased (pointed in different directions) in order to perforate the formation along a 360 circumference. A capsule charge should be distinguished from normal charges in that capsule charges are sealed charges, sealed against hostile ambient temperatures and pressures normally found in oil well boreholes. Normal charges are not sealed; therefore, a carrier tube must encompass the normal charges in order to protect the charges from the hostile borehole temperatures and pressures. Gun 10 includes a plurality of capsule charges 10*a* which are phased, that is, each charge is pointed in a different direction. A primer cord 10*b* weaves around each charge for detonating the charge in response to a detonation stimulus. Each charge is connected to the next, adjacent charge via cotter pins 10*c*. When the gun 10 is lowered into the borehole, an impact with a borehole obstruction often breaks the cotter pins. Therefore, the base strip of gun 10, on which the capsule charges 10*a* are mounted, is not rigid or rugged enough to withstand the impact with the borehole obstruction. In FIG. 1*b*, gun 12 includes a plurality of capsule charges which are phased and which are connected to each other via rivets 12*a*. The rivets 12*a* of gun 12 also break when the gun impacts an obstruction in the borehole. Since gun 10 and gun 12 are put together with cotter pins or rivets, the base strip on which the charges mount is not a single, unitary structure. This non-unitary structure detracts from the ruggedness of the guns 10 and 12.

Figure 2A:
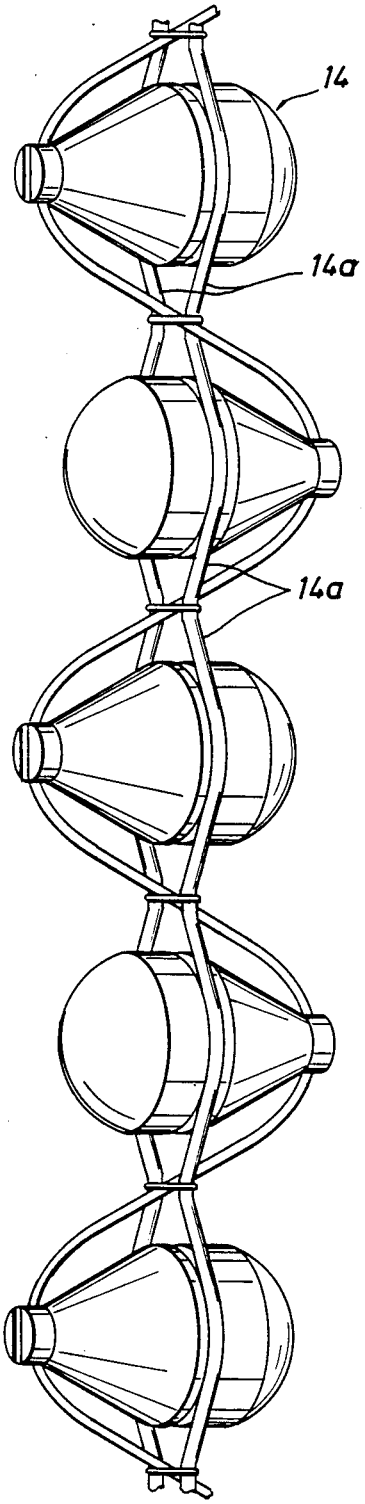
FIG. 2a (PRIOR ART)
FIG. 2*a* and 2*b*, illustrates the prior art wire and strip type semi-expendable guns.
Figure 2B:
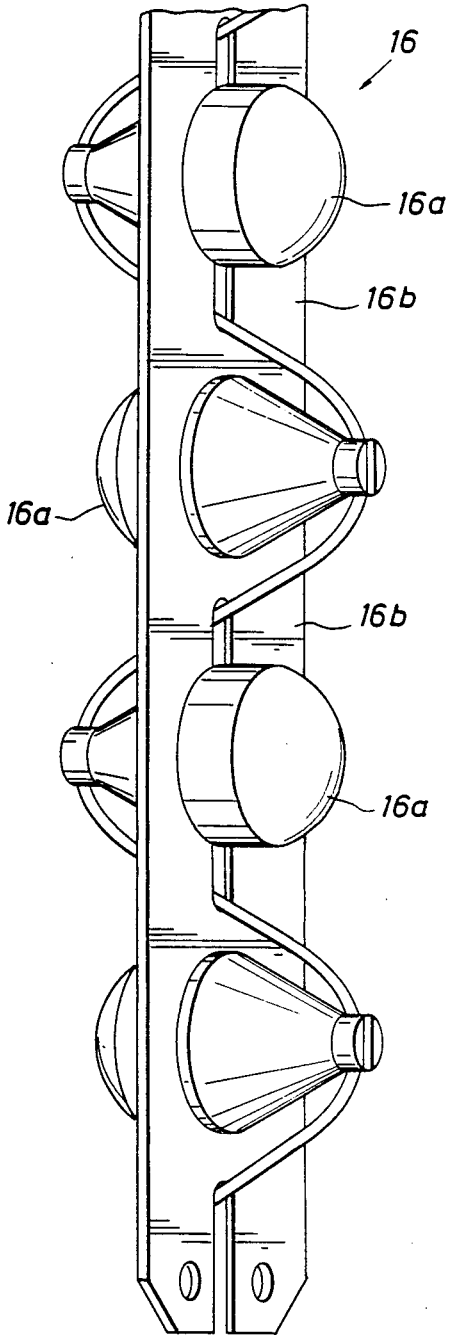
FIG. 2b (PRIOR ART)

In FIG. 2, inclusive of FIG. 2*a* and 2*b*, prior art embodiments of wire or strip type semi-expendable perforating guns are illustrated. Gun 14 of FIG. 2*a* includes a plurality of phased capsule charges connected together by wires 14*a*. When gun 14 is lowered into a borehole, the wires 14*a*, being so small and relatively brittle, break upon impact with an obstruction in the borehole. Gun 16 of FIG. 2*b* includes a plurality of capsule charges 16*a* mounted on a rigid base structure 16*b*. While the base structure 16*b* is rigid, the charge diameter is restricted by the rigid base (which means reduced penetration); the base, being a thin sheet metal with large holes, bends easily and is not so rigid; and the base does not shatter in response to detonation of charges (long pieces of the base survive the discharge).

Figure 3:
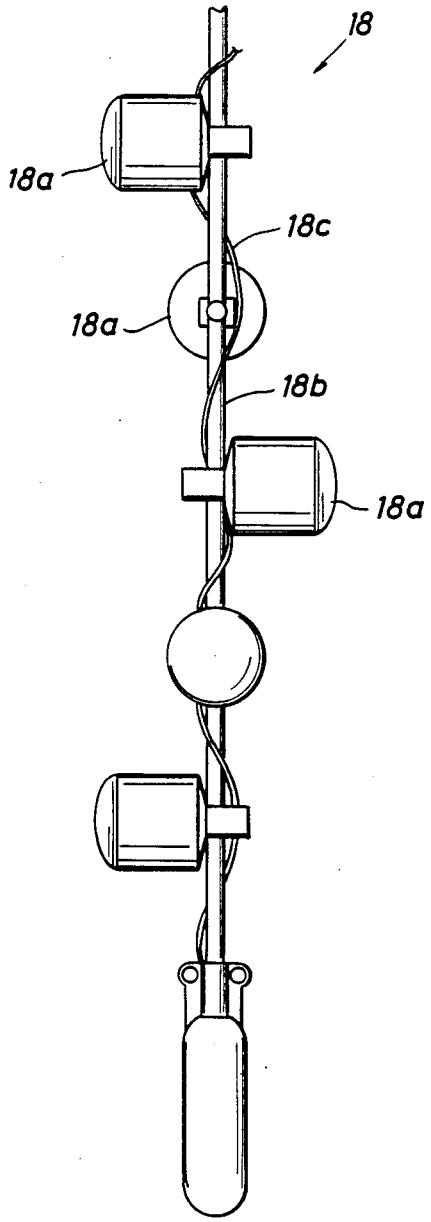
FIG. 3 (PRIOR ART)
FIG. 3 illustrates another prior art embodiment of a capsule type, phased, large diameter perforating gun.

Referring to FIG. 3, another prior art embodiment of a perforating gun is illustrated.

In FIG. 3, a perforating gun 18 includes a plurality of capsule charges 18*a* mounted on a straight, relatively rigid base strip 18*b*. The base structure 18*b* may be hollow, allowing a primer cord to be inserted through the center thereof for connection to each of the charges 18*a*. In FIG. 3, the primer cord wraps around the base strip 18*b*. The problem with this embodiment is the size or diameter of the gun 18. Relative to the prior art embodiments of FIGS. 1 and 2, the diameter of the gun 18 is greatly increased with respect to the diameter of the guns 10, 12, 14 and 16.

Figure 4:
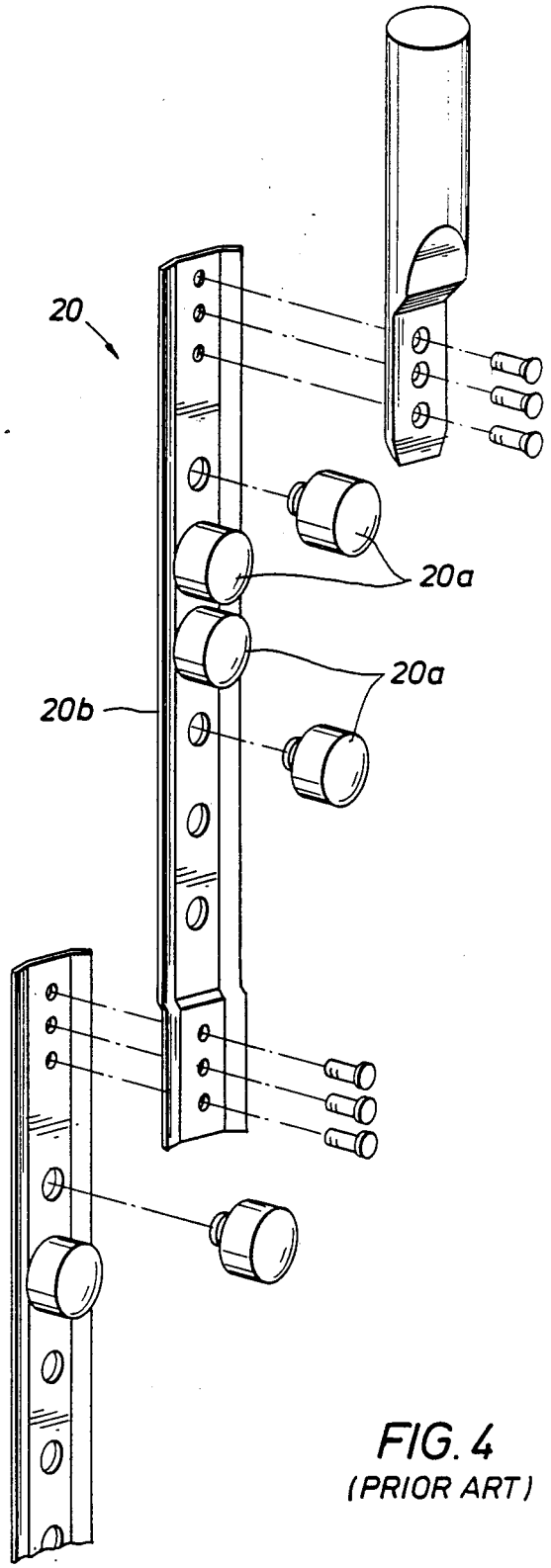
FIG. 4 (PRIOR ART)
FIG. 4 illustrates another prior art embodiment of a capsule charge, non-phased perforating gun.

Referring to FIG. 4, another prior art embodiment of a perforating gun is illustrated.

In FIG. 4, a gun 20 includes a plurality of capsule charges 20*a* mounted on a rigid base strip 20*b* which consists of a metallic strip having a plurality of holes disposed therethrough for connection to the corresponding plurality of capsule charges 20*a* as indicated in the drawing. However, gun 20 and, in particular, the base strip 20*b*, is not designed in a way which would allow the charges 20*a* to be phased, that is, pointed in different directions, in order to permit perforation along a 360 degree circumference in the borehole. The metallic strip 20*b* is not constructed and designed in a manner which, when the charges are mounted on the strip, would allow the charges to be phased.

Figure 5:
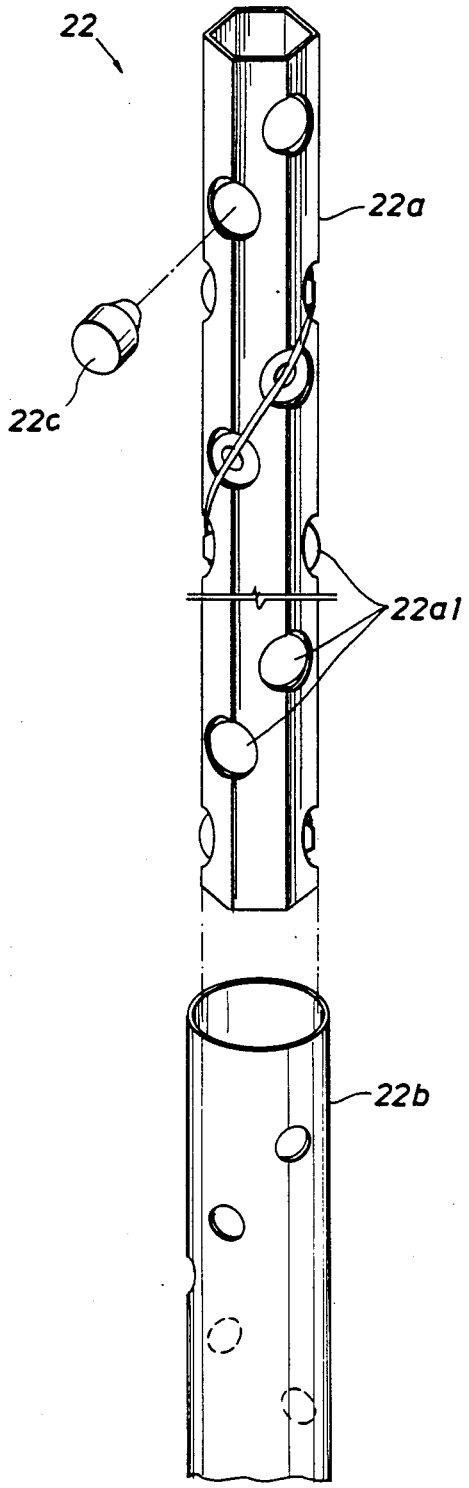
FIG. 5 (PRIOR ART)
FIG. 5 illustrates another prior art embodiment of a phased, non-capsule charge perforating gun.

Referring to FIG. 5, another prior art embodiment of a perforating gun is illustrated.

In FIG. 5, a phased, non-capsule charge perforating gun 22 is shown to include a base strip 22*a*, a plurality of normal, non-sealed charges 22*c* inserted in the base strip 22*a*, and a carrier tube 22*b* enclosing and protecting the base strip 22*a* and its normal non-sealed charges. The base strip 22*a* consists of a tube having a plurality of holes 22*a*1 disposed therethrough, the holes 22*a*1 allowing a corresponding plurality of non-capsule charges 22*c* (normal, non-sealed charges) to be inserted therein. Since the normal charges are not sealed, a carrier tube 22*b* must enclose the base structure 22*a* and the normal, non-sealed charges. As a result, the normal non-sealed charges 22*c* will be protected from the hostile ambient borehole temperatures and pressures The problem with this embodiment, however, is the fact that the charges are not sealed. This requires an additional structure not present in the other prior art embodiments mentioned hereinabove, the additional structure being a carrier tube 22*b* for protecting the charges from the hostile temperatures and pressures present in a borehole environment.

Figure 6:
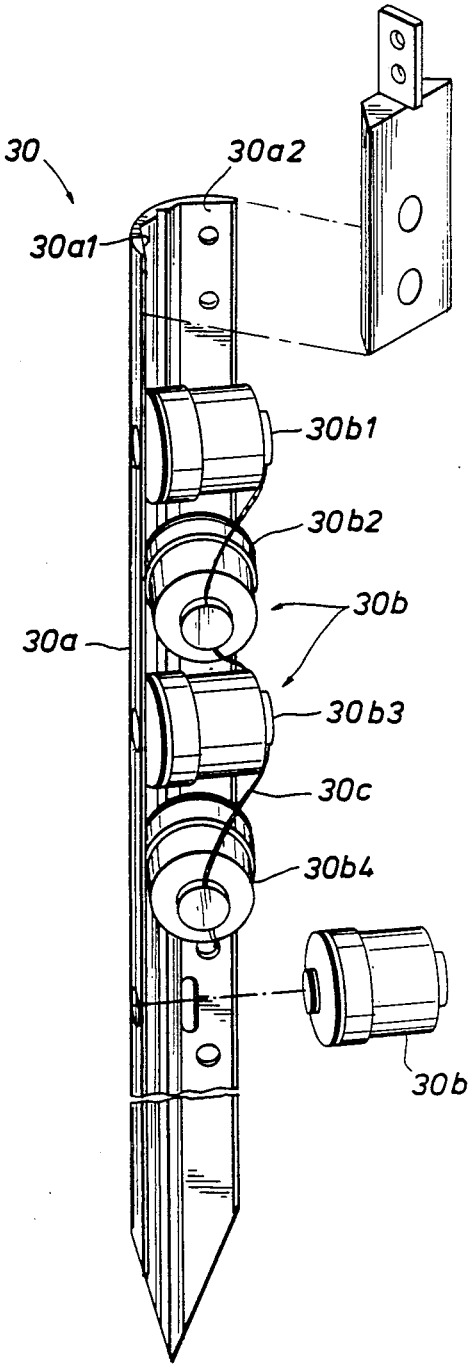
FIG. 6 illustrates a capsule charge, phased, normal diameter perforating gun in accordance with the present invention.

Referring to FIG. 6, a three dimensional view of the perforating gun 30 in accordance with the present invention is illustrated. In FIG. 6, gun 30 includes a base strip 30*a* and a plurality of capsule charges 30*b* mounted on the base strip 30*a*. As mentioned hereinabove, the capsule charges 30*b* are sealed charges, sealed against the hostile temperatures and pressures found in oil well boreholes. Therefore, there is no need for a carrier tube, similar to carrier tube 22*b* of FIG. 5. The capsule charges 30*b* are phased, in that they are mounted on the base strip 30*a* in a manner which allows a first charge to be pointed in a direction which is different than the direction in which an adjacent, second charge is pointing. In FIG. 6, a first capsule charge 30*b*1 is pointing in a first direction, a second capsule charge 30*b*2 is pointing in a second direction, a third capsule charge 30*b*3 is pointing in the first direction, a fourth capsule charge 30*b*4 is pointing in the second direction, etc. A detonating cord (primer cord) 30*c* weaves in and out, radially, connecting one capsule charge to another in order to maintain the diameter of the perforating gun 30 as small as possible and still provide energy for detonation of the charges 30*b*. The diameter of the phased perforating gun of FIG. 6 is no larger than the diameter of prior art non-phased perforating guns (such as that which is shown in FIG. 4). Therefore, the phased perforating gun of FIG. 6, in accordance with the present invention, will easily fit into a standard borehole tubing string, one into which the prior art non-phased perforating gun (of FIG. 4 will also fit. Furthermore, the base strip 30*a* of FIG. 6 is a rigid structure, one which is strong enough to withstand an impact with a borehole obstruction when lowering the gun into a borehole, yet brittle enough to shatter into a multitude of pieces when the charges 30*b* of FIG. 6 detonate. The base strip 30*a* shatters into a multitude of pieces in response to detonation of the capsule charges mounted thereon. The strip 30*a* shatters as a result of two important structural characteristics of the base strip: (1) the base strip 30*a* is comprised of unique materials designed to allow the strip to easily shatter, yet withstand an impact with a borehole obstruction (see chemical composition limits below), and (2) the base strip includes a number of grooves and holes designed to assist in the shattering of the strip in response to charge detonation. The base strip 30*a* is comprised of the following materials:

Chemical Composition limits—1.20 to 2.0 Cu; 2.1 to 2.9 Mg; 0.30 max Mn; 0.40 max Si; 0.50 max Fe; 0.18 to 0.28 Cr; 5.1 to 6.1 Zn; 0.20 max Ti; 0.05 max others (each): 0.15 max others (total): remainder: Al.

These materials, which comprise the base strip 30*a*, are classified as a 7000 series Aluminum Alloy, as defined by the Aluminum Association. Many other alloys belonging to this classification have acceptable mechanical and chemical properties and may be used as the basic material which comprises the base strip 30*a*.

Referring to FIG. 6*a*, a table of 7000 series Aluminum alloys, as defined by the Aluminum Association, is illustrated. The table of FIG. 6*a* may be found in the "Metals Handbook", ninth edition, Vol 2, "Properties and Selection—Nonferrous Alloys and Pure Metals", published by the American Society for Metals (ASM), copyright 1979 by ASM, the disclosure of which is incorporated by reference into this specification. In FIG. 6*a*, the properties of other alloys, which may comprise the materials which constitute the base strip 30*a*, is illustrated. In the preferred embodiment, and as shown in FIG. 6*a*, the base strip 30*a* is specifically comprised of ALUMINUM 7075-T651 as defined by the Aluminum Association. Note the properties of ALUMINUM 7075T651 in FIG. 6*a*.

In FIG. 6, the gun 30 functions to permit capsule charges to be mounted on the base strip 30*a* in a manner which will phase the capsule charges (point adjacent capsule charges in different directions), yet the diameter of the gun 30 is not increased relative to prior art non-phased perforating guns (such as that which is shown in FIG. 4). It is important to prevent an increase in the diameter of the perforating gun, when phasing the charges, since it is desirable and necessary to insert the phased charges of FIG. 6 in the tubing string currently being used by the non-phased perforating gun of FIG. 4. In the preferred embodiment, the diameter of the perforating gun of FIG. 6 is not increased primarily because of the specific angular cross sectional configuration of the base strip 30*a* shown in FIG. 6, and as more fully set forth in FIGS. 7 and 8. Furthermore, the base strip 30*a* of FIG. 6 will not break upon impact with an obstruction when the gun 30 is being lowered into the borehole, yet, the base strip 30*a* will shatter when the charges 30*b* of FIG. 6 detonate in the borehole; this function is the result of the material which comprises the base strip 30*a*: (1) ALUMINUM 7075-T651, as defined above and shown in FIG. 6*a*; (2) or any of the other 7000 series aluminum alloys shown in FIG. 6*a*.

Referring to FIGS. 7, including FIG. 7*a* and 7*b*, a more complete construction of the specific configuration of the base strip 30*a*, shown in FIG. 6, is illustrated.

In FIG. 7, the base strip 30*a* of FIG. 6 comprises a metallic strip. The metallic strip in cross section, taken along the line 7*a*—7*a*, is shown in FIG. 7*a*. In FIG. 7*a*, it is clear from the drawing that the metallic strip 30*a* is a piece of metal alloy bent along a longitudinal axis extending lengthwise along the base strip until two surfaces are formed: a first surface 30*a*1 which includes approximately one-half of the base strip 30*a*, and a second surface 30*a*2 disposed approximately 90 degrees with respect to the first surface 30*a*1 and including approximately the other one-half of the base strip 30*a*. Surface 30*a*1 includes a plurality of holes 30*a*3 disposed therethrough extending longitudinally along the length of the base strip and surface 30*a*2 includes another plurality of holes 30*a*4 disposed therethrough and extending longitudinally along the length of the base strip, each of the plurality of holes 30*a*3 and 30*a*4 functioning to allow connection of a capsule charge 30*b* to the particular surface 30*a*1/30*a*2 of the base strip 30*a*. A groove 30*a*5 runs longitudinally along a length of the strip 30*a*, separating the first surface 30*a*1 from the second surface 30*a*2. As noted in FIG. 6, a first capsule charge 30*b*1 is connected to the first surface 30*a*1 of base strip 30*a*, a second capsule charge 30*b*2 is connected to the second surface 30*a*2 of the base strip 30*a*, a third capsule charge 30*b*3 is connected to the first surface 30*a*1 of the base strip 30*a*, a fourth capsule charge 30*b* is connected to the second surface 30*a*2 of the base strip, etc. In other words, the successive capsule charges 30*b* are connected, alternatingly, to the first and second surfaces 30*a*1 and 30*a*2, respectively, of the base strip 30*a*. In this way, the diameter of the perforating gun 30 is maintained at a minimum while retaining the phasing of the capsule charges in at least two directions. Since the metallic strip 30*a* of FIG. 7 is an alloy in the 7000 series, as defined above, and specifically, a 7000 series Aluminum alloy, the base strip is strong enough to withstand impact with a borehole obstruction, when disposing the perforating gun in a borehole, yet is brittle enough to shatter when the charges, connected to the base strip 30*a*, detonate. The base strip 30*a* shatters into a multitude of pieces, in response to charge detonation, along lines defined by the longitudinal groove 30*a*5 and the holes 30*a*3 and 30*a*4 on the strip.

Referring to FIG. 8, a cross section of the base strip 30*a* of FIG. 7*b*, taken along section lines 8—8 of FIG. 7*b*, is illustrated. In FIG. 8, the base strip 30*a* includes the groove 30*a*5, a first reduced thickness section 30*a*6, and a second reduced thickness section 30*a*7. When the capsule charges 30*b* detonate, the base strip 30*a* shatters into a multitude of pieces, along lines defined by the groove 30*a*5, the holes 30*a*3 and 30*a*4, and the first and second reduced thickness sections 30*a*6 and 30*a*7. The strip 30*a* shatters into the multitude of pieces in part due to the material which comprises the base strip (see chemical composition limits herein) and in part due to the reduced thickness of the base strip 30*a* at the groove 30*a*5 and at the first and second reduced thickness sections 30*a*6 and 30*a*7. The holes 30*a*3 and 30*a*4 also contribute to the shattering of the base strip into a multitude of pieces. It is important that the strip shatter into multitude of pieces in order that the strip, when shattered, will fall well below the perforating zone thereby not obstructing the flow of oil or gas from well servicing equipment.

In operation, capsule charges 30*b* are connected to first surface 30*a*1 and second surface 30*a*2, alternatingly, such that a first plurality of capsule charges 30*b*, connected to the first surface 30*a*1, point in a first direction which is approximately perpendicular to the first surface 30*a*1, and a second plurality of capsule charges 30*b*, connected to the second surface 30*a*2, point in a second direction which is approximately perpendicular to the second surface 30*a*2. Since the first surface 30*a*1 is disposed at approximately a 90 degree angle with respect to the second surface 30*a*2, the first plurality of charges 30*b* connected to the first surface 30*a*1 may be interleaved with the second plurality of charges, connected to the second surface 30*a*2, thereby phasing the charges 30*b* while maintaining a minimum diameter of the perforating gun 30. As a result, the perforating gun 30 of FIGS. 6–7 will fit easily within a standard tubing string, the same tubing string that was used with respect to the prior art non-phased charge perforating gun of FIG. 4. When the perforating gun of FIG. 6 travels or moves in the borehole, if it impacts an obstruction in the borehole, the base strip 30*a* of gun 30 will not break, since the strip 30*a* is made of rigid metallic material alloy capable of withstanding the impact. Furthermore, the base strip 30*a* of FIGS. 6–8 is a single, unitary structure (it is not comprised of a plurality of sections, connected together by cotter pins, as shown in FIG. 1). Since the capsule charges 30*b* are connected to the first and second surfaces 30*a*1 and 30*a*2, as shown in FIG. 6 and 7, the primer or detonating cord 30*c* weaves in and out, radially, connecting one capsule charge to another; this assists in maintaining the minimum diameter of the gun 30 of FIG. 6–8. Since capsule charges are being used, a carrier tube is not necessary, thereby eliminating an extra structural requirement for the gun 30. In addition, since the charges are still phased, perforation in at least two directions is still being performed. In short, the gun 30 of the present invention is rugged, has good penetration, and includes phased capsule charges, the three most important qualities which must be present in any good perforating gun. In addition, base strip 30*a* of gun 30 shatters upon detonation thereby minimizing the "full height" of the debris in the well. In response to charge detonation, the base strip of the Prior art, as in FIG. 2*b*, includes long pieces of debris (deformed but near the original length) located at the bottom of the well. It is important to minimize the full height of the debris in the well because the well tool perforator may be located near the bottom of the well (or near other well structures) and, as a result, long pieces of debris may obstruct the flow of oil or gas from the well servicing equipment. Gun 30 of the present invention includes a base strip 30*a* which will shatter into a multitude of very small pieces in response to detonation of the charges in the perforating gun thereby allowing the resultant debris from the base strip 30*a* to fall well below the perforating zone thereby not obstructing the flow of oil or gas from the well servicing equipment. As a result, the gun 30 possesses all the advantages of the prior art guns, without possessing any of their disadvantages.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A perforating gun adapted to be lowered through a production tubing disposed in a borehole, comprising:

a metallic base strip having a single unitary structure consisting of a first surface lying in a first plane and a second surface connected to and substantially coextensive with said first surface and lying in a second plane which is different than said first plane whereby said unitary structure of said first and second surfaces provide structural support and resistance to bending action to each other;

mounting holes in said first surface for mounting a first plurality of capsule explosive charges to said first surface; and mounting holes in said second surface for mounting a second plurality of capsule explosive charges to said second surface such that they are interleaved with said first plurality of capsule charges, said strip being comprised of a special material which, together with said holes, will cause said strip to shatter into a multitude of pieces in response to detonation of said first and second plurality of capsule explosive charges.

2. The perforating gun of claim 1, wherein said second surface is disposed approximately perpendicular to said first surface.

3. The perforating gun of claim 2, wherein said material of said base strip provides resistance to shattering when said strip impacts an obstruction in said tubing.

4. The perforating gun of claim 3, wherein said material comprises an Aluminum alloy.

5. The perforating gun of claim 4, wherein said Aluminum alloy comprises Copper, Magnesium, Manganese, Silicon, Iron, Chromium, Zinc, Titanium, and Aluminum.

6. The perforating gun of claim 4, wherein said metallic strip includes a groove.

7. The perforating gun of claim 6, wherein said metallic strip includes at least one reduced thickness section, said material, said holes, said groove and said reduced thickness section together causing said strip to shatter into a multitude of pieces in response to detonation of said capsule, but providing resistance to shattering upon impact with an obstruction in said tubing.

* * * * *